United States Patent [19]

Deal

[11] Patent Number: 4,872,674

[45] Date of Patent: Oct. 10, 1989

[54] BASEBALL PITCHING PRACTICE DEVICES

[76] Inventor: Clifton R. Deal, Rte. 1, Box 1321, Blue Ridge, Ga. 30513

[21] Appl. No.: 145,547

[22] Filed: Jan. 19, 1988

[51] Int. Cl.[4] ..... A63B 69/40

[52] U.S. Cl. ..... 273/26 A

[58] Field of Search ..... 273/26 A, 29 A, 176 K, 273/26 E, 401, 181 F

[56] References Cited

U.S. PATENT DOCUMENTS

| | | | |
|---|---|---|---|
| 2,839,300 | 6/1958 | Blaha et al. | 273/26 A |
| 3,197,208 | 7/1965 | Makar | 273/26 A |
| 3,706,451 | 12/1972 | Dixon | 273/26 A |
| 3,711,092 | 6/1973 | Hogue | 273/26 A |
| 3,997,158 | 12/1976 | Britton | 273/26 A |
| 4,295,648 | 10/1981 | Stromback | 273/26 A |
| 4,497,485 | 2/1985 | Macosko | 273/26 A |
| 4,657,250 | 4/1987 | Newland et al. | 273/26 A |

*Primary Examiner*—Edward M. Coven
*Assistant Examiner*—T. Brown
*Attorney, Agent, or Firm*—Leon Gilden

[57] ABSTRACT

The invention relates to a baseball pitcher's practice target comprised of a backstop first target frame supporting a net for receiving a ball and rebounding the ball back to the pitcher. A second target attached to the frame and in front of the first target. The second target being constructed from a plurality of cross-links which define an adjustable rectangular strike zone. A third target is attached to the frame and in front of the second target. The third target is comprised of a disk suspended from the frame by a flexible member.

1 Claim, 4 Drawing Sheets

BASEBALL PITCHING PRACTICE DEVICES

BACKGROUND OF THE INVENTION

1. Field of the Invention

The present invention relates to recreational devices, and more particularly pertains to several embodiments of a new and improved baseball pitching practice device which includes the use of a movable target and a selectable size strike zone.

2. Description of the Prior Art

Various types of baseball pitching practice devices which utilize adjustable size strike zones are well known in the prior art. Typical examples of such selectable size strike zones are to be found in U.S. Pat. No. 3,312,467, which issued to B. Dawson on Apr. 4, 1967, and U.S. Pat. No. 3,583,703, which issued to W. Brown on June 8, 1971. Both of these practice pitching devices include frame structures having rectangularly shaped strike zones defined by flexible lines or targets, with these strike zones being adjustable in size to facilitate the needs of a practicing pitcher. However, neither of these devices utilize backstop nets, nor is the strike zone size variable whereby a pitcher could concentrate manner towards throwing a ball into a particular portion of the strike zone.

There has been at least a couple of attempts to develop throwing target devices which allow for a rebound of a ball thrown thereagainst, while also defining a more specific target area for the thrower. For example, U.S. Pat. No. 3,672,672, which issued to H. Rubin on June 27, 1972, discloses a rectangular frame structure having a net suspended thereabout so as to provide a ball rebounding function. Positioned behind the net is a clearly visible, impact actuated bell which serves as a specific target for a thrower. The bell is attached to a downwardly extending arm which is adjustably movable, and the ball rebound device comprising the invention is essentially directed to a use by football players who need to practice their passing game.

A similar device is to be found in U.S. Pat. No. 3,698,712 which issued to V. Pero on Oct. 17, 1972. The Pero device comprises a portable frame having a backstop net stretched thereacross, and a hollow plastic baseball bat is removably spring-mounted in front of the net. The bat serves as a specific target for a baseball pitcher and will actually effectively rebound a ball towards the pitcher if a perfect strike is thrown.

While both the Rubin and Pero devices provide very specific targets for a thrown ball, neither of these devices are designed to define a more realistic target area, such as defining a strike zone in combination with the specific target already associated with the practice device. Inasmuch as the art is relatively crowded with respect to these types of ball pitching practice devices, it can be appreciated that there is a continuing need for and interest in improvements to such practice aids, and in this respect, the present invention addresses this need and interest.

SUMMARY OF THE INVENTION

In view of the foregoing disadvantages inherent in the known types of baseball pitching practice devices now present in the prior art, the present invention provides an improved baseball pitching practice device wherein the same is of a portable construction and makes use of a small specifically movable target positionable within various areas of an adjustable size strike zone formed in front of a rebound net. As such, the general purpose of the present invention, which will be described subsequently in greater detail, is to provide new and improved baseball pitching practice devices which have all the advantages of the prior art baseball pitching practice devices and none of the disadvantages.

To attain this, representative embodiments of the concept of the present invention are illustrated in the drawings and make use of portable backstop frames having rebound nets stretched thereacross. The various embodiments of the invention, only two of which are illustrated in the drawings for conceptual purposes, make use of rods or flexible lines which can be moved relative to one another to define different size strike zones in front of a rebound net. Additionally, each of the embodiments of the invention envisions the use of a tennis ball suspended from a flexible member and positionable within various portions of a preselected size strike zone. As such, a pitcher is provided with a defined strike zone which comprises a first target means, with such pitcher also being provided with a specific target in the form of the suspended tennis ball which then defines a second target means for further improving the accuracy of his pitching.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball pitching practice device which has all the advantages of the prior art baseball pitching practice devices and none of the disadvantages.

It is another object of the present invention to provide a new and improved baseball pitching practice device which may be easily and efficiently manufactured and marketed.

It is a further object of the present invention to provide a new and improved baseball pitching practice device which is of a durable and reliable construction.

An even further object of the present invention is to provide a new and improved baseball pitching practice device which is susceptible of a low cost of manufacture with regard to both materials and labor, and which accordingly is then susceptible of low prices of sale to the consuming public, thereby making such baseball pitching practice devices economically available to the buying public.

Still yet another object of the present invention is to provide a new and improved baseball pitching practice device which provides in the apparatuses and methods of the prior art some of the advantages thereof, while simultaneously overcoming some of the disadvantages normally associated therewith.

Still another object of the present invention is to provide a new and improved baseball pitching practice device which makes use concurrent of various size targets in combination with a rebound net and backstop.

These together with other objects of the invention, along with the various features of novelty which characterize the invention, are pointed out with particularity in the claims annexed to and frming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
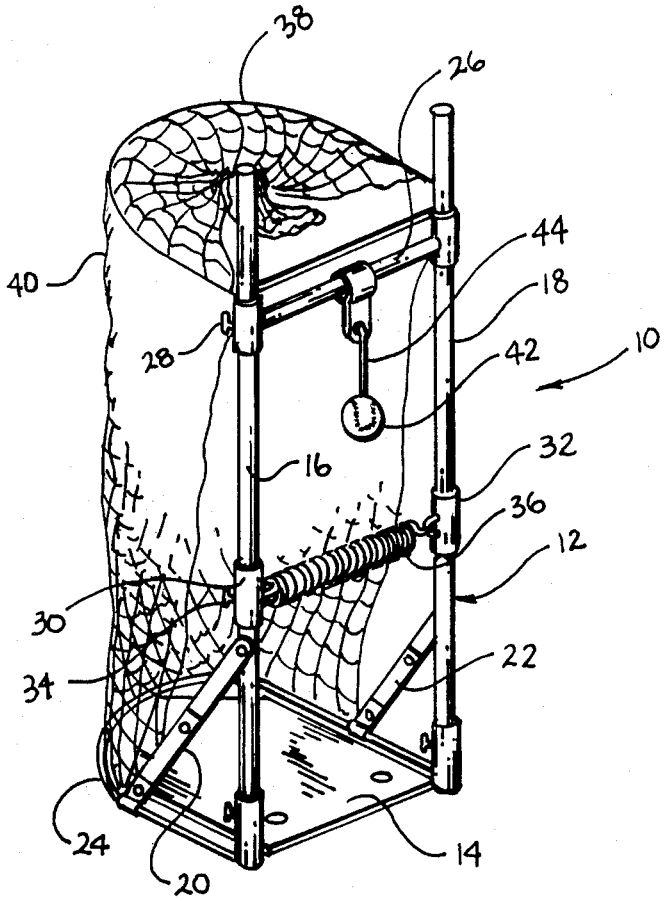
FIG. 1 is a perspective view of a first embodiment of baseball pitching practice device comprising the present invention.

With reference now to the drawings, and in particular to FIG. 1 thereof, a first representative embodiment of a new and improved baseball pitching practice device embodying the principles and concepts of the present invention and generally designated by the reference numeral 10 will be described.

More specifically, it will be noted that the first embodiment 10 of the invention includes a backstop frame 12 which is of a collapsible design and which may have a conventional size home plate 14 positioned between a pair of upstanding stanchions 16, 18 that form the basic frame structure. The stanchions 16, 18 are upstandingly supported by a pair of foldable arms 20, 22 attached between a rigid hoop member 24 and the respective stanchions. Additionally, a first cross-extending member 26 is slidably positionable upwardly or downwardly on the stanchion 16, 18, with thumb screws 28 being utilized to secure the slidable member in a desired position.

A pair of slidable sleeves 30, 32 are also adjustably positioned on the respective stanchions 16, 18, and thumb screws 34 may be utilized to lock these sleeves in a desired location. A resilient spring member 36 may be interconnected between the sleeves 30, 32 in the illustrated manner, and the spring member serves as a further cross-extending member similar to the arm 26. Of course, it is to be understood that a further cross-extending arm 26 could be utilized in place of the spring 36, and the use of the spring is just for purposes of illustrating the versatility of design present in the invention.

With further reference to FIG. 1 of the drawings, it will be noted that the cross-extending member 26 has a further rigid hoop member 38 movably attached thereto, with this hoop member being similar in design and construction to the aforementioned hoop member 24. A flexible nylon net 40, or the like, is stretched between the hoop members 24, 38 to define a ball catching backstop and, as is now apparent, the members 26, 36 can be moved towards or away from each other along the stanchions 16, 18 to thus define a rectangularly shaped strike zone of a desired size. This strike zone then constitutes a first target area for a pitcher utilizing the first embodiment 10 of the invention.

Recognizing that many pitchers are substantially skilled, it becomes desirable to provide a means of more precisely defining a specific area of the strike zone as a target. This is accomplished by the use of a tennis ball 42 which is suspended on a flexible member 44 that is in turn adjustably attached to and is movable along the cross-extending member 26. Accordingly, a pitcher is provided with the aforementioned first target means comprising a strike zone defined by the stanchions 16, 18 and the cross-extending members 26, 36, while also being provided with the second target means 42 which is selectively movable and positionable within the strike zone.

Figure 2:
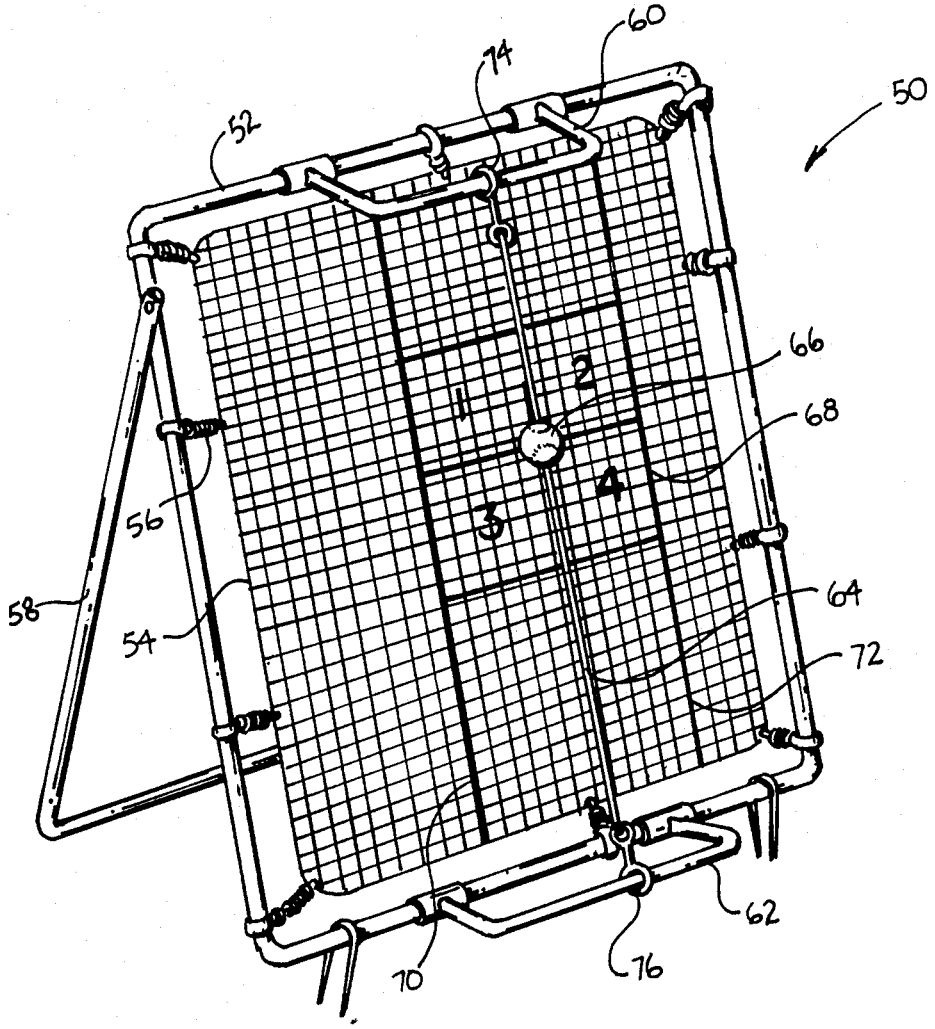
FIG. 2 is a perspective view of a second embodiment of the invention.

FIG. 2 of the drawings illustrate the versatility of design available for the present invention. In this respect, a second embodiment of the invention, which is generally designated by the reference numeral 50, comprises a rectangularly shaped frame structure 52 having a rebound net 54 stretched under tension thereacross. In this regard, a plurality of spring members 56 are used to hold the net 54 in a tensioned position upon the frame structure. A pivotal U-shaped support 58 can be employed to position the pitching device 50 in a desired location, and a pair of U-shaped support arms 60, 62 are adjustably movable along opposite sides of the frame structure 52 in the illustrated manner. A length of flexible line 64 is positioned between the members 60, 62, and a tennis ball 66 is slidably movable upon the line. A target 68 is also adjustably movable in front of the rebound net 54 and can be retained in position by stretchable bands or ropes 70, 72 or, if desired, rods could be substituted for the ropes 70, 72 whereby the target 68 would be slidably movable along the rods. As illustrated, the target area 64 can be divided into four quadrants and appropriately numbered so as to indicate to a pitcher the accuracy of his throw. As is now apparent with respect to the manner of usage of the second embodiment 58 of the invention, the tennis ball 66 may be moved upwardly or downwardly relative to the target 68 as a result of a slidable movement thereof upon the retaining line 64. Additionally, the tennis ball 66 can be moved to the left or right of the target 68 by an appropriate slidable movement of the line 64 upon the U-shaped members 60, 62. This left or right movement can be facilitated by attaching the supporting line 64 to the U-shaped members 60, 62 through the use of slidably movable ring members 74, 76.

Figure 3:
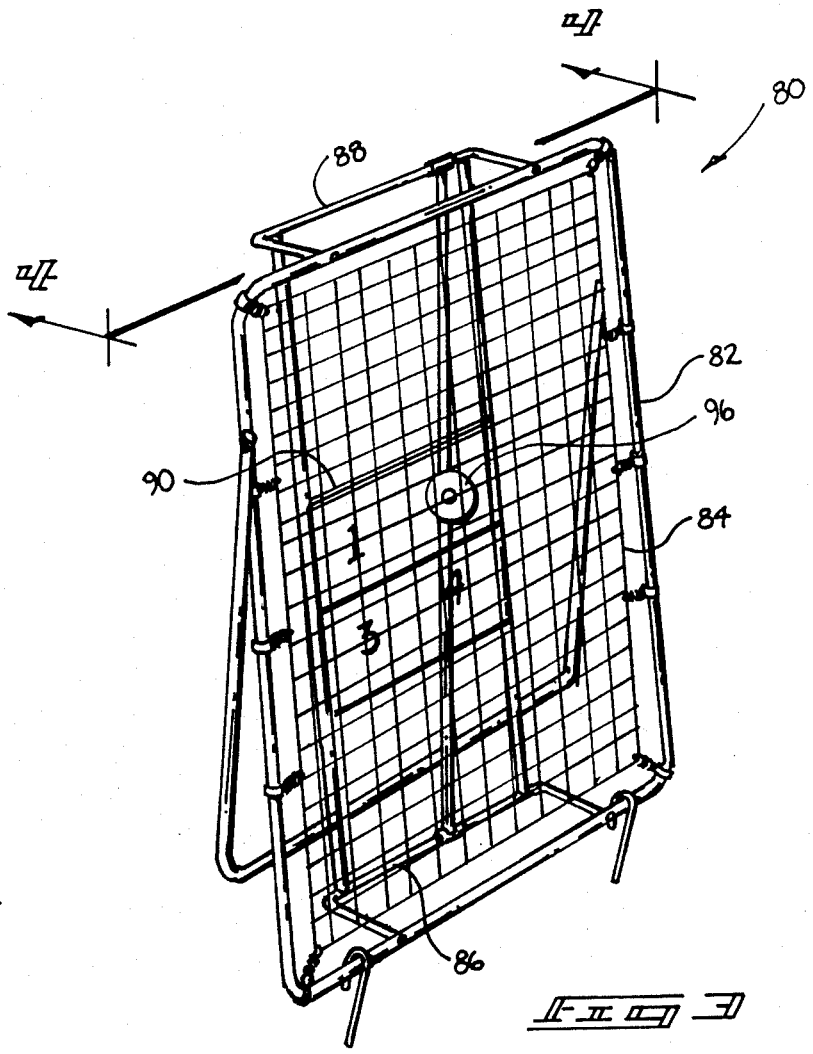
FIG. 3 is a perspective view of a third embodiment of the invention.
Figure 4F:
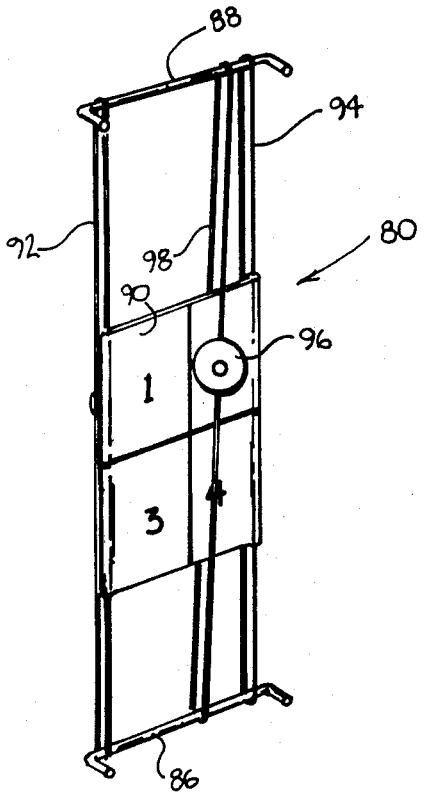
FIG. 4 is a cross-sectional perspective view of the invention as viewed along the line 4—4 in FIG. 3.

FIGS. 3 and 4 of the drawings illustrate a third embodiment of the invention which is generally designated by the reference numeral 80. The embodiment 80 is similar in construction to the previously discussed embodiments 10, 50; however, it will be observed that a frame 82 which supports a rebound net 84 includes a pair of rearwardly extending rectangularly shaped support structures 86, 88. A further movably positionable target 90 is supported upon a pair of flexible continuous lines 92, 94, and these lines are looped about the support structures 86, 88 in the illustrated manner. Through slidable movement of the lines 92, 94, target 90 can be adjusted upwardly or downwardly, as well as laterally.

In place of the tennis balls 42, 66, the embodiment 80 of the invention utilizes a plastic target disk 96 which is retained upon a further continuous loop of line 98, and this further line is also movably positioned between the support structures 86, 88. As such, the target disk, which in a preferred embodiment would most likely be approximately four inches in diameter and would be formed from a plastic material, may be adjustably positioned in any direction in front of the numbered quadrants defined upon the face of the target 90. This embodiment of the invention provides for a more accurate return of a thrown ball inasmuch as no deflection of a thrown ball is occasioned by its striking a flat target disk 96. In this regard, the embodiment 50 of the invention could cause a deflection of the thrown ball when the same strikes the tennis ball 66, while the embodiment 10 of the invention provides for no return of a thrown ball.

As is now obvious from the above description, the manner of usage and operation of the present invention is clearly defined therein. Accordingly, no further disucssion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved baseball pitching practice device comprising, backstop frame, ball receiving net positioned across said backstop frame means, said ball receiving net defining a first target;

a second target adjustable selectively positioned in front of said first target means attaching said second target to said frame; and third target adjustable positioned in front of said second target, said third target being attached to said frame and being movable relative, said second target and wherein said net comprises a rebound net designed to effect a rebound of a ball thrown thereagainst and back to an individual who has thrown said ball, and wherein said second target comprises an adjustable size strike zone, and wherein said strike zone is defined by movable cross-linked members which define a rectangular shape to thus establish said strike zone, and wherein said third target comprises a disk supported on a flexible member.

* * * * *

UNITED STATES PATENT AND TRADEMARK OFFICE

CERTIFICATE OF CORRECTION

PATENT NO. : 4,872,674

DATED : October 10, 1989

INVENTOR(S) : Clifton R. Deal

It is certified that error appears in the above-identified patent and that said Letters Patent is hereby corrected as shown below:

IN THE ABSTRACT

Line 5, change "in front of" to --behind--

IN THE CLAIM

Line 25, delete "means";

Lines 27 and 28, change "in front of" to --behind--;

Line 28, after "first target" insert a comma (,);

Line 30, change "adjustable" to --adjustably--; and,

Line 32, after "relative " change the comma (,) to --to--.

Signed and Sealed this

Thirty-first Day of January, 1995

Bruce Lehman

*Attest:*

BRUCE LEHMAN

*Attesting Officer*

*Commissioner of Patents and Trademarks*